US010172454B2

(12) United States Patent
Moon

(10) Patent No.: US 10,172,454 B2
(45) Date of Patent: Jan. 8, 2019

(54) COLLECTING CLOTHES APPARATUS

(71) Applicant: ROICHEN CO., LTD, Seoul (KR)

(72) Inventor: Jae-Gu Moon, Seoul (KR)

(73) Assignee: ROICHEN CO., LTD, Seoul (KR)

( * ) Notice: Subject to any disclaimer, the term of this patent is extended or adjusted under 35 U.S.C. 154(b) by 0 days.

(21) Appl. No.: 15/460,783

(22) Filed: Mar. 16, 2017

(65) Prior Publication Data

US 2018/0008040 A1 Jan. 11, 2018

(30) Foreign Application Priority Data

Jul. 6, 2016 (KR) ..... 10-2016-0085457

(51) Int. Cl.
*A47B 57/26* (2006.01)
*A47B 61/00* (2006.01)
*A47G 25/06* (2006.01)

(52) U.S. Cl.
CPC ..... *A47B 57/265* (2013.01); *A47B 61/003* (2013.01); *A47G 25/06* (2013.01)

(58) Field of Classification Search
CPC ..... A47B 57/265; A47B 61/003; A47G 25/06
USPC ..... 211/85.2, 50, 49.1, 88.01, 90.01, 113, 211/117, 126.1, 126.5, 126.13, 135, 187, 211/153, 87.01; 108/107, 108, 147.11, 108/147.17; 248/220.21, 220.31, 221.11, 248/220.43, 235, 239, 241, 243, 247, 248, 248/250
See application file for complete search history.

(56) References Cited

U.S. PATENT DOCUMENTS 361,111 A * 4/1887 Baines ..... A47B 57/567 248/244
427,462 A * 5/1890 Crider ..... A47B 57/567 248/244
471,357 A * 3/1892 Grundy ..... B42F 17/02 312/192
576,939 A * 2/1897 Baines ..... A47B 57/567 248/244
747,945 A * 12/1903 Cook ..... A45C 5/00 211/50
768,295 A * 8/1904 Palfrey ..... A47B 57/42 248/243
966,002 A * 8/1910 Fricke ..... A47B 57/265 108/107
1,053,996 A * 2/1913 Isbell ..... A47B 57/265 108/107
1,059,464 A * 4/1913 Hine ..... A47B 57/265 108/107

(Continued)

FOREIGN PATENT DOCUMENTS

KR 10-0643162 B1 11/2006
KR 20-2012-0004500 Y1 10/2012

*Primary Examiner* — Jonathan Liu
*Assistant Examiner* — Devin K Barnett
(74) *Attorney, Agent, or Firm* — Jefferson IP Law, LLP

(57) ABSTRACT

An apparatus for collecting clothes is provided. The apparatus includes a bracket disposed perpendicularly to an installing surface and provided with one pair of guides, the one pair of guides protruding in front of the bracket from left and right ends of the bracket to have a vertical length, and trays horizontally coupled in front of the bracket as at least one layer to place arranged clothes on top surfaces of the trays, wherein each of the trays has left and right ends supported by the one pair of guides.

9 Claims, 7 Drawing Sheets

(56) References Cited

U.S. PATENT DOCUMENTS 1,172,260 A * 2/1916 Crist ..... A47B 96/022 248/220.1
1,456,446 A * 5/1923 Hotaling ..... A47F 7/148 211/181.1
2,215,884 A * 9/1940 Runge ..... A61B 5/1072 126/30
2,302,140 A * 11/1942 Paulin ..... A47B 87/02 211/188
2,414,334 A * 1/1947 Schild ..... A47F 5/103 108/101
2,743,021 A * 4/1956 Glenn ..... A47F 5/112 211/49.1
2,794,555 A * 6/1957 Schild ..... A47B 96/021 108/107
2,928,512 A * 3/1960 Slater ..... A47B 57/565 248/243
2,928,551 A * 3/1960 Abrams ..... A47F 5/0087 108/2
2,949,192 A * 8/1960 Maliff ..... A47F 5/112 211/49.1
3,028,975 A * 4/1962 Bullock ..... B42F 7/12 211/126.12
3,168,365 A * 2/1965 Evans ..... A47B 57/16 108/109
3,278,149 A * 10/1966 Brucker ..... A47B 57/52 211/208
3,645,486 A * 2/1972 Ferdinand ..... A47B 57/30 108/108
3,885,846 A * 5/1975 Chuang ..... A47B 57/482 108/110
4,086,858 A * 5/1978 Howitt ..... A47B 57/34 108/110
4,158,998 A * 6/1979 Clement ..... A47B 57/16 108/147.15
4,242,970 A * 1/1981 Suttles ..... A47F 5/103 108/108
4,506,790 A * 3/1985 Muscari ..... A47F 5/116 108/180
4,756,430 A * 7/1988 Spamer ..... A47F 7/16 108/108
5,150,776 A * 9/1992 Rebenack ..... A45C 13/02 190/110
5,154,385 A * 10/1992 Lindberg ..... A47B 57/562 248/225.11
5,529,322 A * 6/1996 Barton ..... A45C 5/14 108/147.11
5,564,346 A * 10/1996 Robben ..... A47B 9/00 108/108
5,758,585 A * 6/1998 Latchinian ..... A47B 96/067 108/108
5,893,470 A * 4/1999 Peggs ..... A47B 96/028 211/90.01
5,983,805 A * 11/1999 Waluda ..... A47B 96/022 108/158.12
6,098,818 A * 8/2000 Ali ..... A47F 7/143 211/50
6,105,794 A * 8/2000 Bauer ..... A47B 57/26 108/108
6,126,022 A * 10/2000 Merkel ..... A47B 47/042 108/180
6,227,384 B1 * 5/2001 Saylor ..... A47B 17/033 211/11
6,467,780 B1 * 10/2002 Winslow ..... B62B 1/10 211/50
6,578,498 B1 * 6/2003 Draudt ..... A47B 21/06 108/108
6,758,352 B2 * 7/2004 Gervasi ..... A47F 3/004 108/134
6,763,958 B2 * 7/2004 Gervasi ..... A47F 3/004 108/42
6,772,889 B2 * 8/2004 Moceri ..... A47B 46/00 211/153
6,929,131 B1 * 8/2005 Landi ..... A47F 5/0846 211/87.01
6,929,133 B1 * 8/2005 Knapp, III ..... A47F 5/0807 211/118
7,210,925 B2 * 5/2007 Adachi ..... F27D 5/0037 118/725
7,261,214 B2 * 8/2007 Wagner ..... A47F 5/0823 108/147.11
7,806,282 B1 * 10/2010 LaBonia, Jr. ..... A47B 67/04 211/135
8,172,347 B2 * 5/2012 Lim ..... F25D 25/02 108/106
8,333,448 B2 * 12/2012 Yoon ..... A47B 96/028 108/108
8,646,624 B2 * 2/2014 Fernandez ..... A47B 45/00 108/108
8,651,296 B2 * 2/2014 Beaty ..... A47F 5/11 211/135
8,657,133 B2 * 2/2014 McGowan ..... A47B 81/06 108/108
8,960,822 B1 * 2/2015 Hsu ..... A47B 88/16 312/334.4
9,016,214 B2 * 4/2015 Zang ..... A47F 5/103 108/147.11
9,700,156 B1 * 7/2017 Hance ..... A47B 57/583
2001/0037987 A1 * 11/2001 Culp ..... A47B 47/042 211/186
2002/0043187 A1 * 4/2002 Felton ..... A47B 46/005 108/107
2003/0094427 A1 * 5/2003 Suttles ..... A47B 55/02 211/187
2004/0056574 A1 * 3/2004 Mandel ..... A47B 57/06 312/408
2004/0060884 A1 * 4/2004 Nook ..... A47F 5/0018 211/189
2005/0121275 A1 * 6/2005 Platte, III ..... A45C 5/065 190/103
2005/0189311 A1 * 9/2005 Colby ..... A47F 5/0807 211/94.01
2005/0218767 A1 * 10/2005 Jeong ..... F25D 25/02 312/408
2006/0118502 A1 * 6/2006 Polvere ..... A47F 5/112 211/135
2007/0252498 A1 * 11/2007 Wing ..... F25D 25/02 312/408
2007/0272639 A1 * 11/2007 Alexander ..... A47F 5/10 211/186
2008/0121146 A1 * 5/2008 Burns ..... A47F 5/101 108/23
2008/0257840 A1 * 10/2008 Eley ..... A47F 5/0815 211/59.1
2010/0000950 A1 * 1/2010 Malekmadani ..... A47B 57/10 211/26
2010/0117502 A1 * 5/2010 Kang ..... F25D 25/02 312/408
2010/0193455 A1 * 8/2010 Russell ..... A47B 57/06 211/90.02
2011/0132854 A1 * 6/2011 Berdahl ..... A47F 3/12 211/59.2
2011/0149508 A1 * 6/2011 Malekmadani ..... H05K 7/1489 361/679.48
2013/0213910 A1 * 8/2013 Kang ..... H01L 21/67303 211/41.18
2013/0292350 A1 * 11/2013 Trotta ..... A47F 5/0018 211/135
2014/0175031 A1 * 6/2014 Roberts ..... H02J 7/0027 211/26.2
2014/0238383 A1 * 8/2014 Armstrong ..... F24C 15/16 126/337 A
2014/0238947 A1 * 8/2014 Hao ..... A47B 96/06 211/88.01
2014/0251933 A1 * 9/2014 Old ..... A47F 5/0018 211/90.04
2014/0284291 A1 * 9/2014 Sandgrund ..... A47G 25/06 211/85.3

(56) References Cited

U.S. PATENT DOCUMENTS

| | | | | |
|---|---|---|---|---|
| 2015/0060377 | A1* | 3/2015 | Hu | A47B 63/00 211/50 |
| 2015/0129518 | A1* | 5/2015 | Ho | A47J 47/16 211/41.2 |
| 2015/0289645 | A1* | 10/2015 | Yoshikawa | A47B 61/04 211/36 |
| 2015/0300728 | A1* | 10/2015 | Kim | F25D 25/024 312/408 |
| 2015/0329276 | A1* | 11/2015 | Kosmach | A47B 61/003 206/280 |
| 2016/0176596 | A1* | 6/2016 | Kuipers | A47B 87/0269 211/85.3 |
| 2016/0213146 | A1* | 7/2016 | Gosling | A47B 9/12 |
| 2017/0055699 | A1* | 3/2017 | Neuwirth | A47B 43/04 |
| 2018/0125232 | A1* | 5/2018 | Umstead | A47B 57/545 |

* cited by examiner

COLLECTING CLOTHES APPARATUS

CROSS-REFERENCE TO RELATED APPLICATION(S)

This application claims the benefit under 35 U.S.C. § 119(a) of a Korean patent application filed on Jul. 6, 2016 in the Korean Intellectual Property Office and assigned Serial number 10-2016-0085457, the entire disclosure of which is hereby incorporated by reference.

TECHNICAL FIELD

The present disclosure relates to a clothes-collecting apparatus. More particularly, the present disclosure relates to a clothes-collecting apparatus, in which trays are coupled to a bracket in a multiple stage in a detachable and guiding manner so that the trays may be easily coupled to or separated from the bracket. In addition, even when desired clothes C are detected or drawn out, the remaining clothes C may be maintained in an initial arranged state and the arranged clothes may be easily transferred without being scattered.

BACKGROUND

In general, a clothes chest or an arranging box for keeping clothes, such as a shirt, trousers, etc., is used in each home. After clothes are arranged in a form, the clothes are stored in a storage space in a multiple layer.

However, according to a cloth collecting manner of the related art, a large amount of clothes all are highly stacked, so that it is inconvenient to carry the stored clothes. In addition, the arranged state of the clothes may be scattered while the clothes are transferred.

In addition, according to a cloth collecting manner of the related art, while a user lifts up clothes to confirm a kind of desired clothes or draws out the corresponding clothes, the arrange clothes are scattered so that it is inconvenient to arrange the scattered clothes again.

In addition, according to a cloth collecting manner of the related art, since the stacked clothes are kept in a state that the clothes are tightly closed to each other, it may be difficult for a user to confirm the desired clothes and the clothes cannot be kept in an optimized state without allowing the clothes to make contact with each other.

As one example of the related art, there has been disclosed a cloth collecting box in Korean Unexamined Patent Publication No. 10-2016-0060977 (Published on May 31, 2016).

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a clothes-collecting apparatus in which trays are coupled to a bracket in a multiple stage in a detachable manner, so that the trays may be easily coupled to or separated from the bracket. Even when desired clothes will be detected or drawn out, the remaining clothes may be maintained in an initial arranged state. In addition, since a plurality of trays is coupled to a single bracket, the cloth collecting apparatus may be freely transferred.

Another aspect of the present disclosure is to provide a clothes-collecting apparatus in which trays are rotated based on the portion at which the tray is coupled to a bracket, so that the interval between the trays may be adjusted, thereby easily confirming and drawing out desired clothes.

Another aspect of the present disclosure is to provide a clothes-collecting apparatus in which the number of installed trays may be controlled by extending or reducing the height of a bracket, so that it is possible to adjust the size according to an installing space and the apparatus is not greatly limited by the installing space. In addition, a large amount of clothes may be stored together so that the convenience in use may be secured.

In accordance with an aspect of the present disclosure, an apparatus for collecting clothes is provided. The apparatus includes a bracket disposed perpendicularly to an installing surface and provided with one pair of guides, the one pair of guides protruding in front of the bracket from left and right ends of the bracket to have a vertical length, and trays horizontally coupled in front of the bracket as at least one layer to place arranged clothes on top surfaces of the trays, wherein each of the trays has left and right ends supported by the one pair of guides.

In an implementation, the apparatus further includes a support placed on the installing surface and horizontally formed on a low end of the bracket, wherein the support has an upper portion tightly attached to a low end of one arranged at a lowest position among the trays with a coupling member.

In an implementation, each of the guides has a front end on which a bending surface is formed to be inclined in an opposite direction to the bracket, and the bending surface guides left and right ends of the tray to the guide when the tray is coupled in front of the bracket.

In an implementation, the apparatus further includes at least one auxiliary bracket which is vertically coupled to an upper end of the bracket, and an inserting hole and an inserting protrusion formed on an upper end of the bracket and upper and lower ends of the auxiliary bracket to correspond to each other, such that adjacent ends are coupled to each other as male and female coupling members.

In an implementation, the apparatus further includes a handle protruding upwardly from a rear end of the tray, wherein the handle has an upper end which horizontally supports a low surface of the tray placed thereon when the trays are coupled to a front surface of the bracket.

In an implementation, the apparatus further includes a rounded surface formed on a front low end of the tray, wherein the round surface has a predetermined curvature in a front and back direction.

In an implementation, the apparatus further includes plural pairs of latching members which protrude from a front surface of the bracket and are vertically arranged at left and right sides of the front surface of the bracket, an inserting member protruding from a front end of the tray, wherein left and right ends of the inserting member are latched to left and right side ends in a state that the inserting member is inserted between the latching members.

In an implementation, the latching members have latching holes formed by horizontally penetrating the latching members, wherein the apparatus further comprises latching ends which protrude from left and right side portions of the inserting member to be horizontally inserted into the latching holes.

In an implementation, the apparatus further includes an inclined surfaces formed on front surfaces of the latching members to guide latching ends while being spaced apart from each other by an interval, wherein the inclined surfaces are included from the front ends of the latching members by the interval.

In an implementation, when a rear end of the tray is lifted up or down, the latching end is rotatable in the latching hole.

In an implementation, the apparatus further includes a receiving groove concavely formed on a front surface of the bracket, wherein the latching members are connected integrally and vertically to each other and are correspondingly coupled into the receiving groove in front of the bracket as female and male members.

In an implementation, the latching members slid from an upper portion of the receiving groove such that the latching members are coupled into the receiving groove corresponding to each other as female and male members.

According to the present disclosure, the trays are coupled to the bracket in a multiple stage in a detachable and guiding manner, so that the trays may be easily coupled to or separated from the bracket. Even when desired clothes are detected or drawn out, the remaining clothes may be maintained in an initial arranged state and the arranged clothes may be easily transferred without being scattered.

In addition, since the trays are rotated based on the portions at which the trays are coupled to the bracket, the interval between the trays may be adjusted so that desired clothes may be easily confirmed and drawn out.

In addition, since the number of installed trays may be controlled by extending or reducing the height of the bracket, so that it is possible to adjust the size according to an installing space, the apparatus is not greatly limited by the installing space. In addition, a large amount of clothes may be stored together so that the convenience in use may be secured.

In addition, since the clothes placed on the trays are exposed to an outside while being vertically divided by the trays, a user may easily search for desired clothes and the clothes do not make any contact with each other, so that the clothes are kept in an optimized state.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

However, it should be understood that the present disclosure is not limited to the following embodiments and may be embodied in different ways, and that the various embodiments are provided for complete disclosure and thorough understanding of the disclosure by those skilled in the art. The scope of the present disclosure is defined only by the claims.

In a detailed description of the present disclosure, description of details apparent to those skilled in the art will be omitted for clarity.

Figure 1:
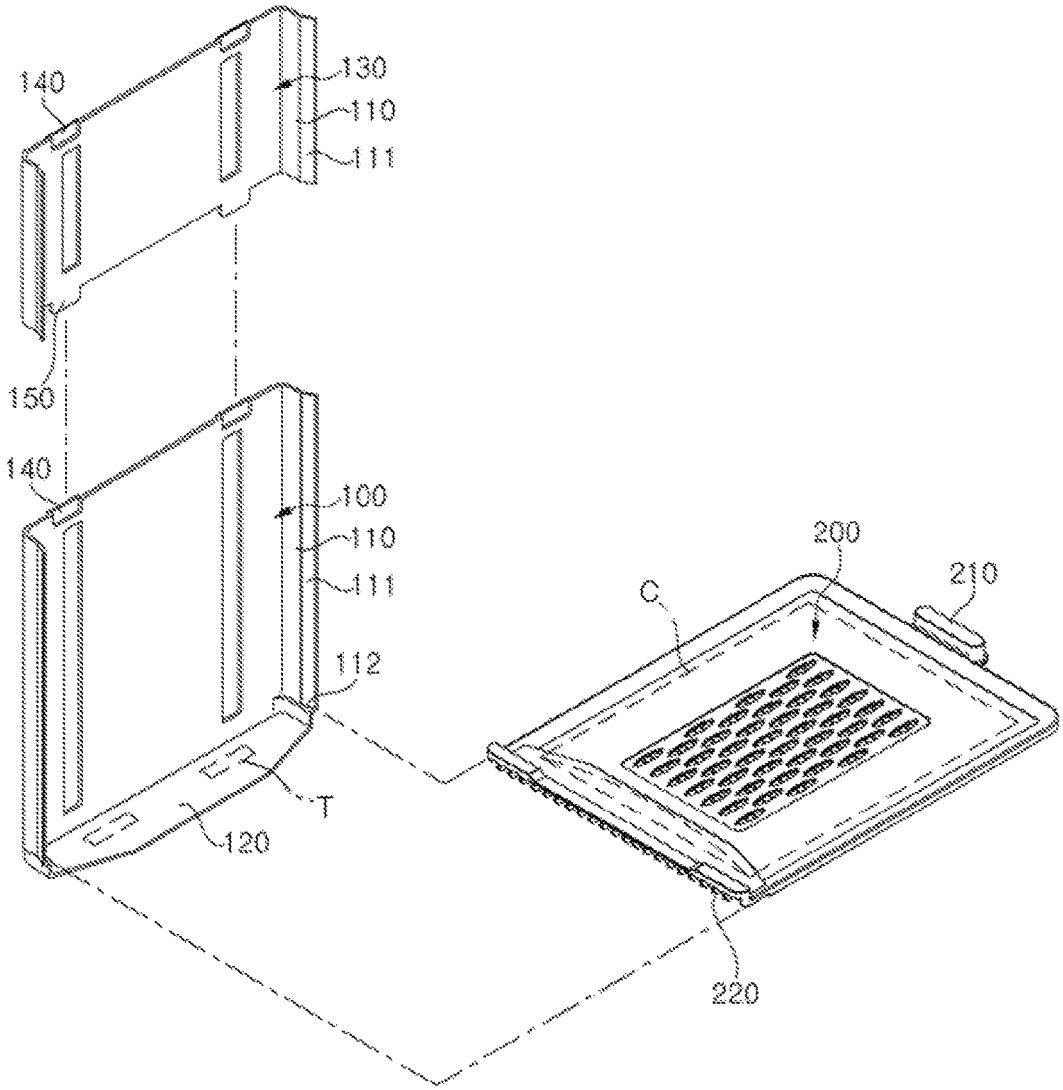
FIG. 1 is an exploded perspective view showing a clothes-collecting apparatus according to an embodiment of the present disclosure.
Figure 2:
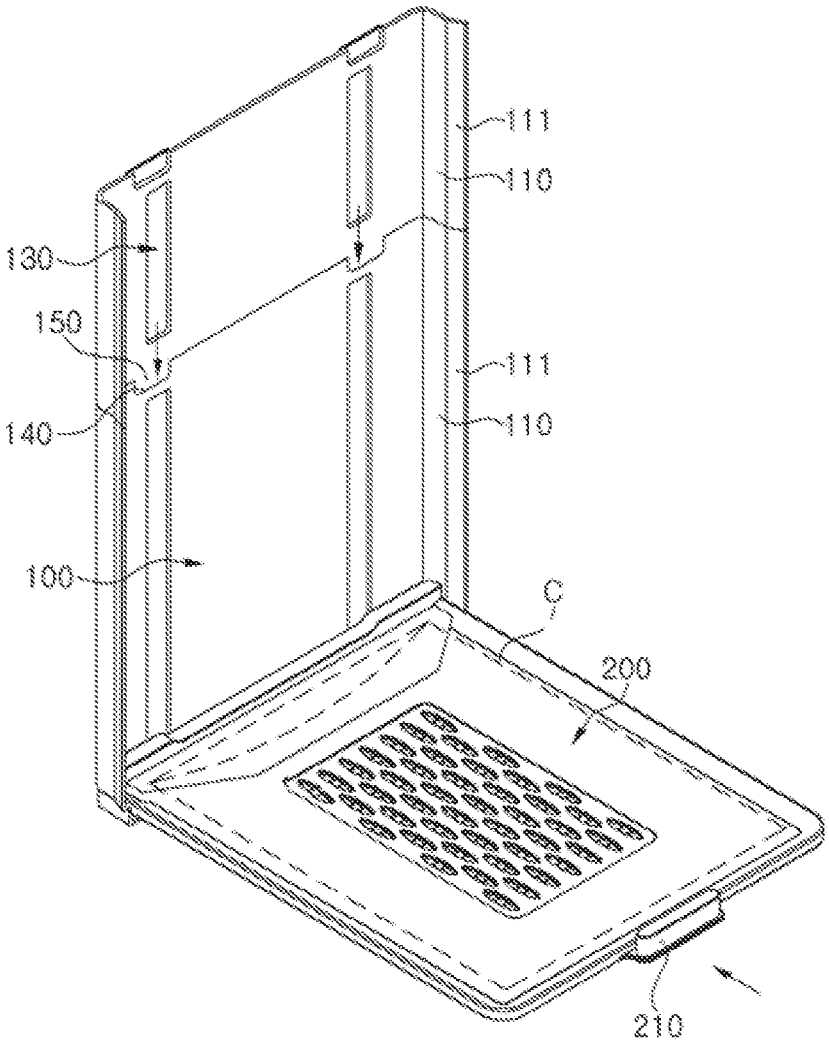
FIG. 2 is an assembled perspective view showing a clothes-collecting apparatus according to an embodiment of the present disclosure.

FIG. 1 is an exploded perspective view showing a cloth collecting apparatus according to an embodiment of the present disclosure. FIG. 2 is an assembled perspective view showing a cloth collecting apparatus according to an embodiment of the present disclosure.

Figure 3:
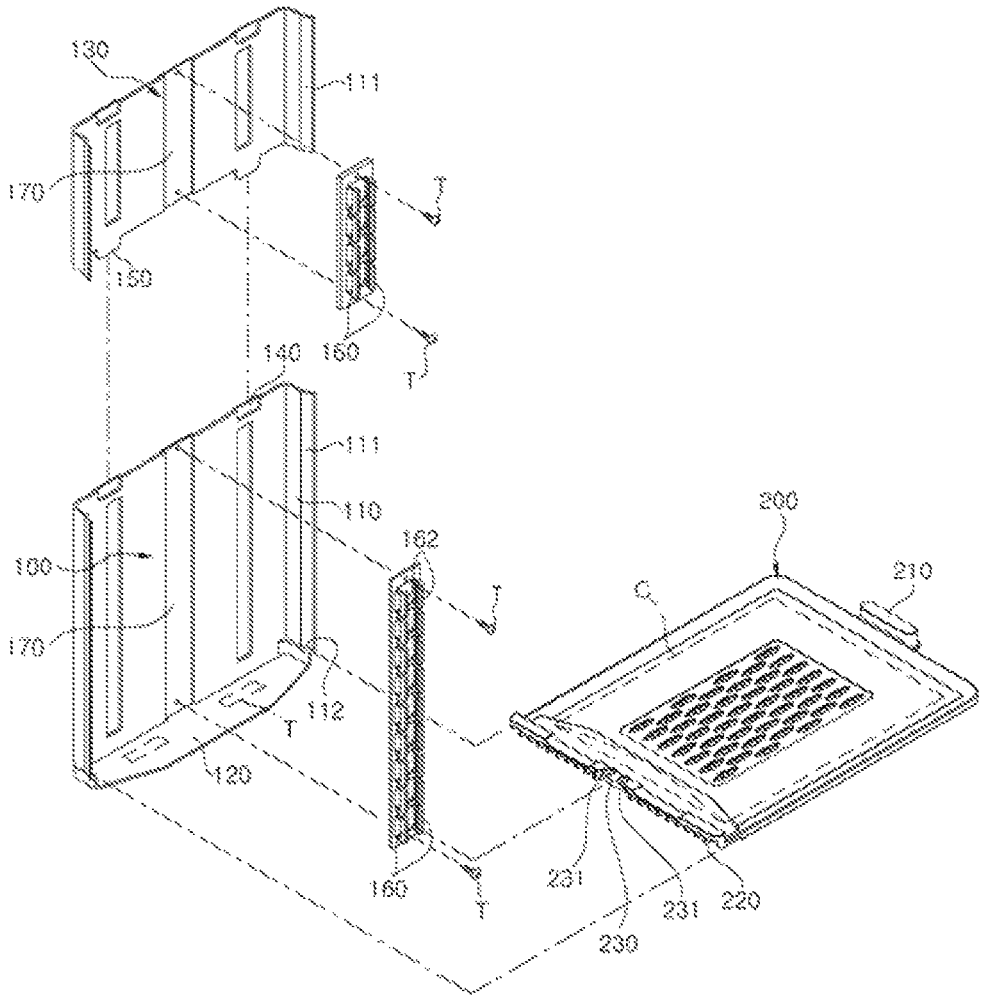
FIG. 3 is a disassembled perspective view showing a state that a latching member and an inserting member are applied to a clothes-collecting apparatus according to an embodiment of the present disclosure.
Figure 4:
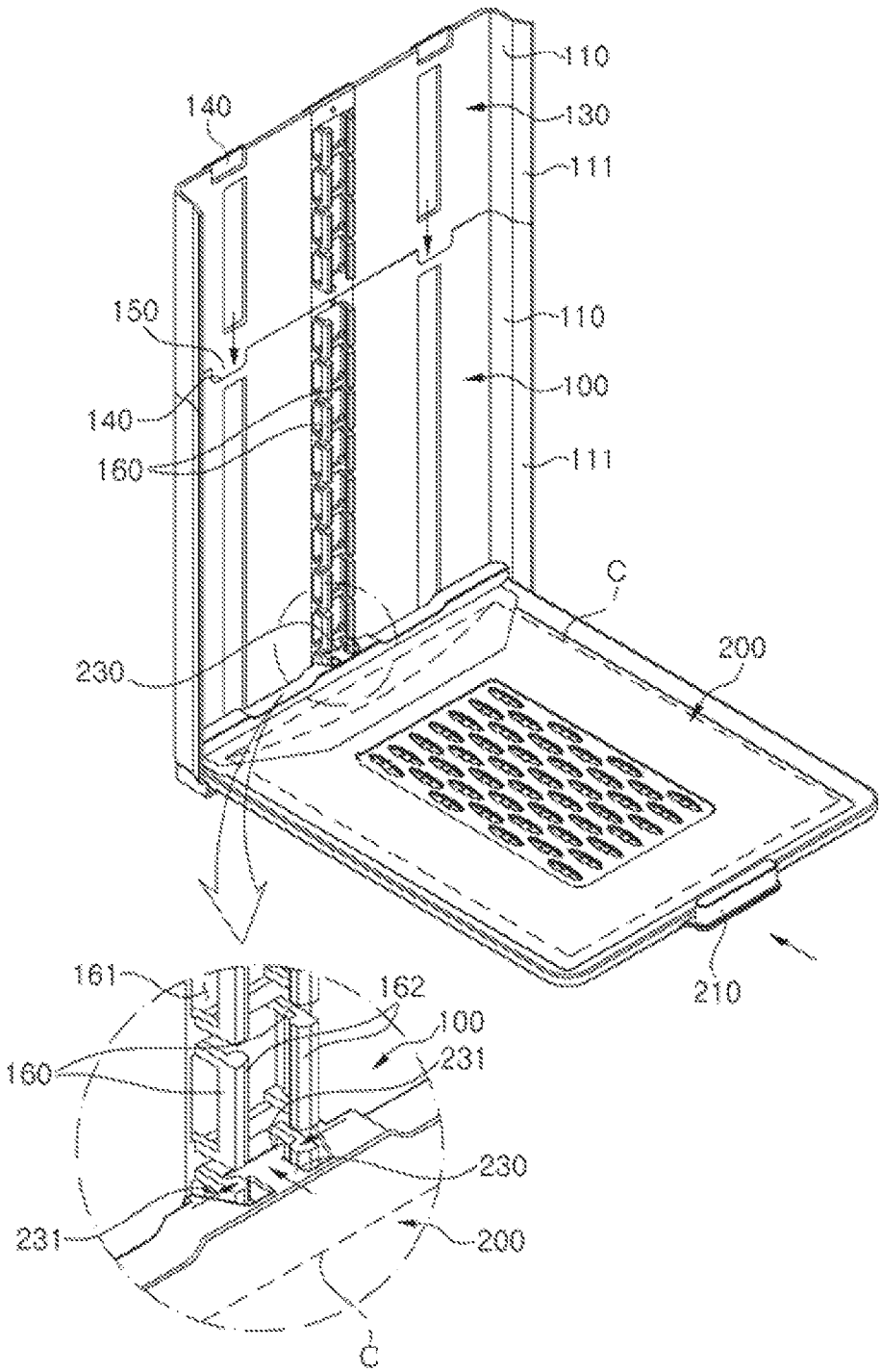
FIG. 4 is an assembled perspective view showing a state that a latching member and an inserting member are applied to a clothes-collecting apparatus according to an embodiment of the present disclosure.

In addition, FIG. 3 is a disassembled perspective view showing a state that a latching member and an inserting member are applied to a cloth collecting apparatus according to an embodiment of the present disclosure. FIG. 4 is an assembled perspective view showing a state that a latching member and an inserting member are applied to a cloth collecting apparatus according to an embodiment of the present disclosure.

Figure 5:
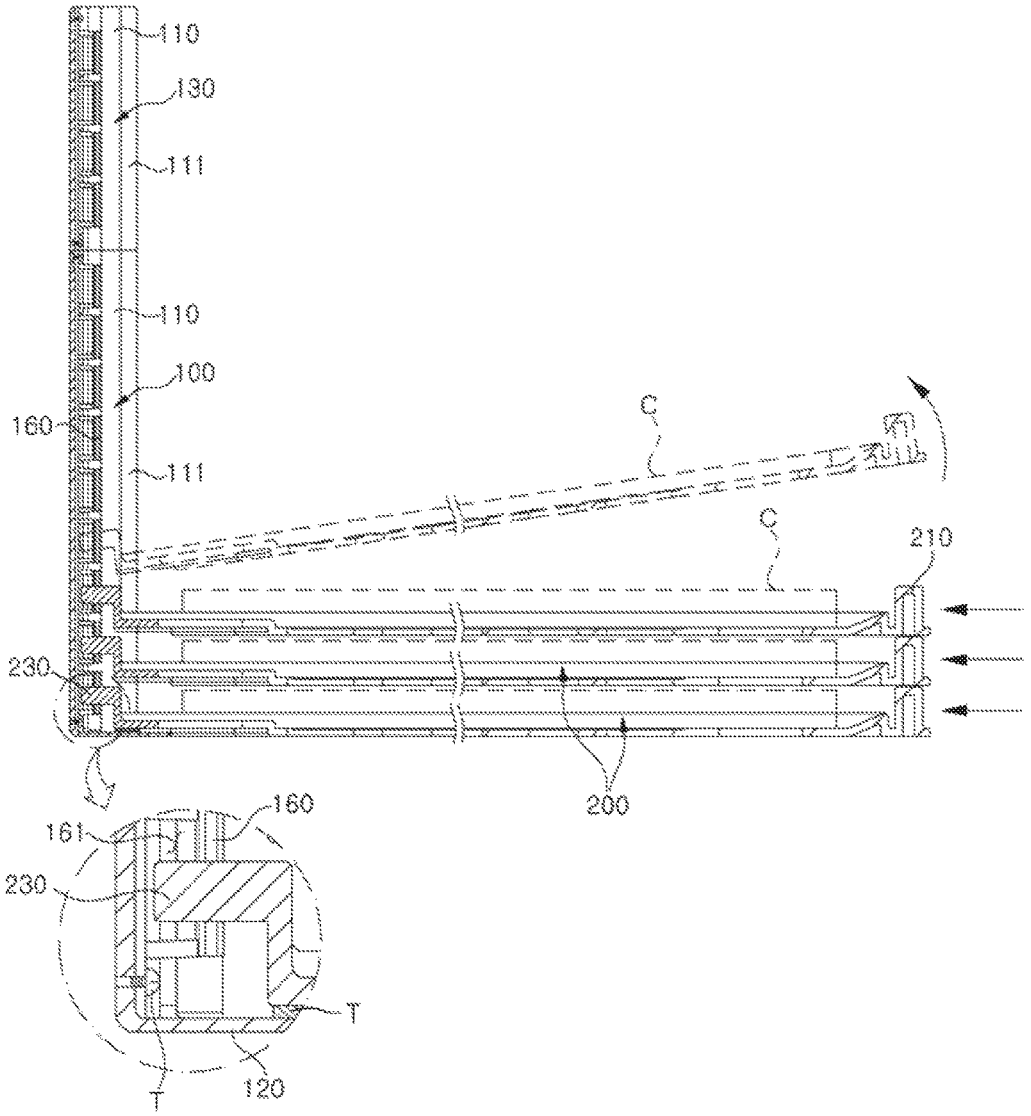
FIG. 5 is an assembled sectional view showing a state that a latching member and an inserting member are applied to a clothes-collecting apparatus according to an embodiment of the present disclosure.
Figure 6:
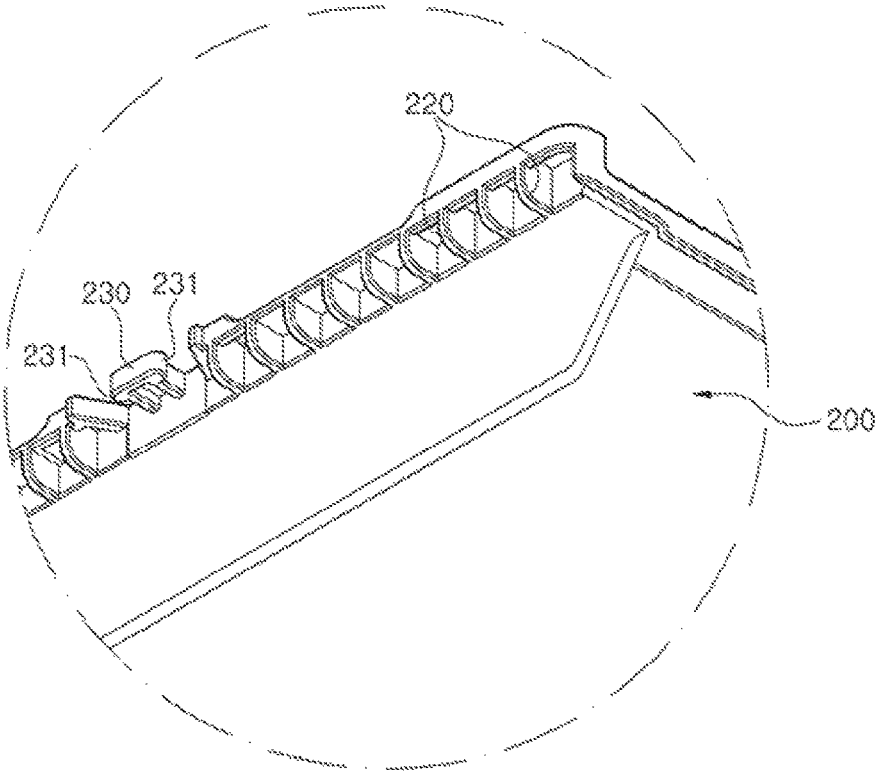
FIG. 6 is a perspective bottom view showing a tray in a clothes-collecting apparatus according to an embodiment of the present disclosure.

FIG. 5 is an assembled sectional view showing a state that a latching member and an inserting member are applied to a clothes-collecting apparatus according to an embodiment of the present disclosure. FIG. 6 is a perspective bottom view showing a tray in a clothes-collecting apparatus according to an embodiment of the present disclosure.

Figure 7:
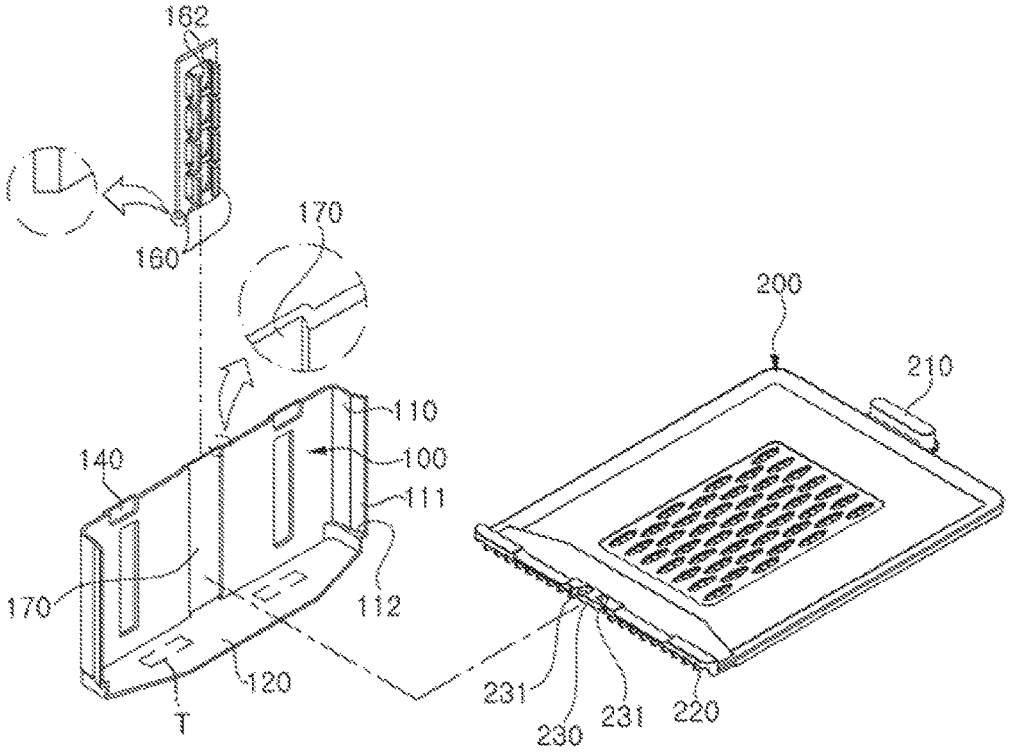
FIG. 7 is a disassembled perspective view showing a state that a latching member of a clothes-collecting apparatus according to an embodiment of the present disclosure is applied in a slide coupling manner.

In addition, FIG. 7 is a disassembled perspective view showing a state that a latching member of a clothes-collecting apparatus according to an embodiment of the present disclosure is applied in a slide coupling manner.

Referring to FIGS. 1 and 2, a cloth collecting apparatus according to an embodiment of the present disclosure includes a bracket 100 and a plurality of trays 200.

First, the bracket 100, which is installed perpendicularly to an installing surface of a clothes chest, may be formed in a shape of a rectangular panel.

The trays 200 which will be described below may be vertically coupled to a front surface of the bracket 100 in a multi-stage form.

Although the bracket 100 is In an implementation manufactured of synthetic resin, the bracket 100 may be selectively manufactured of various materials.

A pair of guides 110, which have a vertical length, protrude in front of the bracket 100 from both left and right ends of the bracket 100.

When the tray 200 is coupled in front of the bracket 100, the pair of guides 110 has a function of guiding both left and right ends of the tray 200 in both directions and supporting both left and right ends of the tray 200 without shaking the tray 200.

In this case, bending surfaces 111 are formed inclined on front ends of the guides 110 in an opposite direction to the bracket 100, respectively. The bending surface 111 guides both left and right ends of the tray 200 to the guide 110 when the tray 200 to be described below is coupled in front of the bracket 100.

That is, since an interval between the bending surfaces 111 is gradually increased in front, when the trays 200 are coupled, the positions may be easily adjusted.

Sills 112 may be formed on corresponding surfaces of the guides 110 to horizontally support left and right low ends of the tray 200.

The sill 112 may be formed at the level of the tray 200 positioned at the lowest end to support the left and right low ends of the tray 200, such that the tray 200 may be horizontally placed.

A support 120, which is placed on an installing surface, may be formed on a low end of the bracket 100 at a predetermined width. The support 120 may extend in front of the bracket 100.

A low end of the tray 200, which is located at the lowest position among the trays 200 coupled to the front surface of the bracket 100, may be tightly closed to an upper portion of the support 120.

In this case, the support 120 and the tray 200 may be coupled to each other with an additional coupling member T. For example, the support 120 and the tray 200 may be coupled to each other by using a double-sided tape.

As another example, the support 120 and the tray 200 may be coupled to each other by using a coupling member T such as a bolt, a screw, a pin, etc.

As shown in FIGS. 1 to 7, a plurality of auxiliary brackets 130 may be further vertically coupled to an upper end of the bracket 100.

An inserting hole 140 and an inserting protrusion 150 may be formed on the upper end of the bracket 100 and the upper and lower ends of the auxiliary bracket 130 to correspond to each other, such that adjacent ends are coupled to each other in a male and female coupling scheme.

That is, the height of the bracket 100 may be extended by using the auxiliary bracket 130, so that more many trays 200 may be coupled.

In addition, although not shown, the brackets 100 may be fixed to the installing surface 10 by using a both-sided tape, a bolt, a screw, a pin, etc.

The arranged clothes are placed on the top surface of the tray 200. Each of the trays 200 may be formed in a shape of a quadrangular or rectangular panel, such that the trays 200 are placed corresponding to those of arranged clothes C.

As shown in FIG. 5, the trays 200 are horizontally coupled in front of the bracket 100 as one layer or a multiple layer.

That is, both left and right side ends of the tray 200 may be supported by one pair of guides 110 and may be placed between the pair of guides 110 without shaking.

In this case, the trays 200 may be sequentially coupled to the bracket 100 from a low end of the bracket 100 to an upper portion of the bracket 100, where the tray 200 located at the lowest end of the bracket 100 is tightly closed to the support 120 of the bracket 100.

In this case, a front low end of the tray 200 may be fixedly attached to the top surface of the support with a both-sided tape and a rear low end of the tray 200 may be stably placed on the installing surface.

In this case, at least one tray 200 may be sequentially coupled over the tray 200 fixed to the top surface of the support 120.

That is, since the guides 110 of the bracket 100 support both left and right ends of the at least one tray 200, the clothes C placed on the trays 200 may be arranged on the front surface of the bracket 100 in order.

In addition, a handle 210 which may be held by a user protrudes upwardly from a rear end of the tray 200.

The handle 210 is formed at a predetermined width in a horizontal direction such that a user pushes the tray 200 into the front surface of the bracket 100 or pulls the tray 200 out of the bracket 100 while holding the handle 210.

In this case, when the plurality of trays 200 are coupled to the front surface of the bracket 100, the handle 210 horizontally supports the bottom surface of the tray 200 placed thereon.

When clothes C are placed on the top surface of the tray 200, at least one through-hole is formed on the top surface of the tray 200 to secure air permeability.

In addition, a rounded surface 220 having a predetermined curvature in a front direction of the tray 200 may be further formed on a front low end of the tray 200.

When one of the trays 200 on which clothes C are placed is separated from the others, the rounded surface 220 prevents the clothes C placed on a tray 200 below it from being drawn out together with the tray 200 while the clothes C are hanged on the tray 200.

addition, additional latching protrusions (not shown) may be formed on both left and right ends of the tray 200, and additional latching protrusions or grooves (not shown) may be formed on corresponding surfaces of the guides 110 described above.

In this case, when the tray 200 is pushed onto the front surface of the bracket 100, since the protrusions or the grooves formed on the latching protrusion and the guides 110 are placed at the latching positions, the coupling strength between the tray 200 and the bracket 100 may be more enhanced.

In addition, as shown in FIGS. 3 to 7, plural pairs of latching members 160 are vertically arranged on left and right portions of the front surface of the bracket 100.

Latching holes 161 may be horizontally formed on the latching members 160. An inclined surface 162 for guiding latching ends 231 to be spaced apart from each other may be formed on front ends of the latching member 160.

The inclined surface 162 faces the latching members 160 and is inclined from the front ends of the latching members 160 toward the center of the interval between the latching members 160.

Thus, as shown in FIGS. 3 to 7, an inserting member 230 may protrude from the front end of the tray 200, where both left and right ends of the inserting member 230 may be latched in a state that the inserting member 230 is inserted between the latching members 160.

As shown in FIGS. 4 and 5, latching ends 231 may protrude from left and right portions of the inserting member 230 such that the inserting member 230 is horizontally inserted into the latching hole 161. That is, the inserting member 230 has a T-shaped front end.

In this case, as shown in FIG. 6, a protrusion end of the latching end 231 may have a curvature in a longitudinal direction to horizontally protrude in left and right directions of the bracket 100.

As described above, when the front end of the inserting member 230 is inserted between the latching members 160, the latching end 231 is guided between the latching members 160 while making contact with the inclined surface 162 of the latching member 160.

In this case, the latching end 231 is horizontally inserted into the latching hole 161 such that the latching end 231 is latched between the latching members 160. Thus, the tray 200 is placed at the front of the bracket 100 while being prevented from being separated backwardly.

Since a protrusion end of the latching end 231 has a predetermined curvature, the latching end 231 may be fitted into the latching hole 161 in such a manner that the tray 200 is pushed forward. To the contrary, the latching end 231 is separated from the latching hole 161 in such a manner that the tray 200 is pulled backward.

In addition, when a rear end of the tray 200 is lifted up or down, the latching end 231, as shown in FIG. 4, the latching end 231 may vertically rotated in the latching hole 161.

That is, in a state that the trays 200 are installed on the front surface of the bracket 100 in a multiple stage, when clothes C placed at a middle portion are to be drawn out therefrom, after the tray 200 positioned right above the tray 200 on which the clothes C are placed is lifted up at an angle of 25 degrees to 30 degrees, specific clothes C may be drawn out.

Thus, when the pair of latching members 160 are coupled to the inserting member 230, after the latching members 160 move apart from each other in left and right directions, the latching members 160 are recovered in the original states due to their own elasticity, such that the latching end 231 is placed at the latching position. Thus, the tray 200 may be coupled to or separated from the front surface of the bracket 100 in a detachable manner.

In addition, when a plurality of brackets 100 are connected to each other, a large amount of clothes are stored at the same time so that the convenience in use may be secured.

In addition, the bracket integrated with the tray 200 may be transferred together with the tray 200, so that the clothes C may be transferred in an arranged state without being scattered.

Meanwhile, as shown in FIGS. 3 to 7, a receiving groove 170 may be concavely formed such that the latching members 160 are coupled to or separated from the front surface of the bracket 100 described above.

In addition, the latching members 160 are connected integrally and vertically to each other. In this case, the latching members 160 may be correspondingly coupled into the receiving groove 170 in front of the bracket 100 as female and male members.

Differently, as shown in FIG. 7, the latching members 160 may slide from an upper portion of the receiving groove 170 such that the latching members 160 are coupled into the receiving groove 170 corresponding to each other as female and male members.

In this case, inclined sills may be formed on both left and right ends of the latching members 160 and the receiving groove 170 such that the latching members 160 are prevented from being separated from the receiving groove 170 in a front direction of the receiving groove 170.

In addition, as shown in FIGS. 3 and 4, the latching member 160 may be coupled into the receiving groove 170 by using a coupling member T such as a bolt, a screw, a pin, a both-sided tape, etc.

Hereinafter, a procedure of assembling and disassembling a clothes-collecting apparatus according to the present disclosure will be described with reference to FIGS. 3 to 7.

First, when the tray 200 is coupled to the front surface of the bracket 100, after clothes arranged in a form is placed on the top surface of the tray 200, the tray 200 is pushed toward the front surface of the bracket 100 at the same height as that of the latching member 160 located at the lowest position.

Then, when the inserting member 230 of the tray 200 is pushed into the gap between the latching members 160, the front ends of the latching members 160 are opened in side directions so that the inserting member 230 is inserted into the gap between the latching members 160.

In this case, the latching end 231 of the inserting member 230 is inserted into the latching hole 161 of the latching member 160 and the front end of the latching member 160 is held by both sides of the latching end 231 of the inserting member 230 while being recovered in the original shape.

In this state, since the latching end 231 of the inserting member 230 is latched into the latching hole 161, the tray 200 may be coupled to the front surface of the bracket 100 without shaking.

Next, in case that the trays 200 are coupled in a multiple stage, a secondary tray 200 may be sequentially coupled above a primary tray 200 first coupled.

In this case, the secondary tray 200 may be supported by the handle 210 of the primary tray 200 and the arranged clothes C are placed between the primary and secondary trays 200.

To the contrary, when the tray 200 is to be separated from the front surface of the bracket 100, the tray 200 may be separated from the front surface of the bracket 100 in reverse order of the assembly.

For example, when a user desires to draw out clothes C, the user may draw out the corresponding tray 200 while holding the handle 210 of the corresponding tray 200.

In this case, the front end of the latching member 160 is opened sufficiently to be separated from the latching end 231 therefrom due to the drawing force, so that only the desired tray 200 may be selectively separated from the front surface of the bracket 100.

As a result, according to the present disclosure, the trays 200 are coupled to the bracket 100 in a multiple stage in a detachable and guiding manner, so that the trays 200 may be easily coupled to or separated from the bracket 100. Even when desired clothes C are detected or drawn out, the remaining clothes C may be maintained in an initial arranged state and the arranged clothes may be easily transferred without being scattered.

In addition, since the plurality of trays 200 are coupled to one bracket 100, the apparatus may be freely transferred. Since the tray 200 is rotated based on the portion at which the tray 200 is coupled to the bracket 100, the interval between the trays 200 may be adjusted so that desired clothes C may be easily confirmed and drawn out.

In addition, since the number of installed trays may be controlled by extending or reducing the height of the bracket 100, it is possible to adjust the size according to an installing space, so that the apparatus is not greatly limited by the installing space. In addition, a large amount of clothes C may be stored together so that the convenience in use may be secured.

While the present disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An apparatus for collecting and storing clothes, which is movable and assembled in a stacked manner, the apparatus comprising:

a vertical bracket disposed perpendicularly to an installing surface, wherein the vertical bracket has a generally C-shaped cross section having a back wall and left and right side end walls thereof defining a pair of guides;

a plurality of trays, the trays having top surfaces on which clothes are adapted to be placed, wherein left and right side ends of each of the trays engage and are supported by the pair of guides when each of the trays is horizontally coupled to the back wall of the vertical bracket in a stacked manner, wherein distal ends of the left and right side end walls define front ends of the guides, wherein the front ends of the guides comprise bent surfaces that are inclined in a direction opposite and away from a center of the back wall of the vertical bracket, an interval between the bent surfaces becomes wider in a direction away from the back wall, and the bent surfaces guide the left and right side ends of each of the trays toward the back wall when the trays are coupled to the vertical bracket;

a plurality of pairs of latching members which protrude from the center of the back wall, wherein each pair of the latching members is vertically spaced with a void formed therebetween along a height of the back wall; and a plurality of T-shaped inserting members, a corresponding T-shaped inserting member among the plurality of T-shaped inserting members protruding from each of the trays, wherein left and right ends of each of the inserting members are latched to and inserted between a corresponding pair of latching members among the plurality of pairs of the latching members, wherein front surfaces of each pair of the latching members define spaced apart inclined surfaces, and wherein the inclined surfaces grip the left and right ends of corresponding ones of the inserting members to maintain the trays in a horizontal orientation.

2. The apparatus of claim 1, further comprising:

a horizontal support formed on a bottom end of the vertical bracket, wherein the horizontal support is configured to be placed on the installing surface, and wherein the horizontal support includes an upper portion that engages a corresponding lower-most tray among the plurality of trays.

3. The apparatus of claim 1, further comprising:

at least one auxiliary bracket which is vertically coupled to an upper end of the vertical bracket, wherein an insert hole is formed on the upper end of the vertical bracket and an insert protrusion is formed on a lower end of the at least one auxiliary bracket, and wherein the insert protrusion is placed within the insert hole to couple the at least one auxiliary bracket to the vertical bracket.

4. The apparatus of claim 1, further comprising:

a plurality of handles, a corresponding handle among the plurality of handles protruding upwardly from each of the trays, wherein each of the handles includes an upper end which is configured to horizontally support a bottom surface of a corresponding upper tray from the plurality of trays when the trays are coupled to the back wall of the vertical bracket.

5. The apparatus of claim 1, wherein each of the plurality of trays comprises a rounded surface formed on a front low end thereof, and, wherein each round surface has a predetermined curvature in a front and back direction.

6. The apparatus of claim 1, wherein each pair of the latching members include latching holes formed therein, and wherein the left and right ends of the corresponding inserting members are configured to be inserted into the corresponding latching holes.

7. The apparatus of claim 1, wherein, when a first end of a corresponding tray among the plurality of trays is lifted up or down, a second end of the corresponding tray is rotated with respects to the back wall.

8. The apparatus of claim 1, further comprising:

a receiving groove formed on a front surface of the back wall of the vertical bracket, wherein each of the latching members is inserted within the receiving groove to couple each of the latching members to the back wall.

9. The apparatus of claim 8, wherein each of the latching members is slidble within the receiving groove.

* * * * *